US005655550A

United States Patent [19]

Keating

[11] Patent Number: 5,655,550

[45] Date of Patent: Aug. 12, 1997

[54] METHOD AND APPARATUS FOR USE IN MAKING FRENCH BRAIDS

[76] Inventor: Patricia A. Keating, 5415 W. 99th Terrace, Overland Park, Kans. 66207

[21] Appl. No.: 549,452

[22] Filed: Oct. 27, 1995

[51] Int. Cl.[6] ..... A45D 24/06

[52] U.S. Cl. ..... 132/133; 132/210; 132/273

[58] Field of Search ..... 132/210, 127, 132/129, 144, 132, 133, 200, 130, 131, 134, 135, 138, 146, 273, 276, 279

[56] References Cited

U.S. PATENT DOCUMENTS

| | | | |
|---|---|---|---|
| 613,104 | 10/1898 | Zimmerman | 132/132 |
| 2,902,042 | 9/1959 | Halber | 132/279 |
| 3,998,233 | 12/1976 | Dorr | 132/279 |
| 5,335,680 | 8/1994 | Moore | 132/133 |
| 5,402,805 | 4/1995 | Barinas | 132/144 |
| 5,518,011 | 5/1996 | Nash | 132/200 |
| 5,544,666 | 8/1996 | Schach | 132/210 |

FOREIGN PATENT DOCUMENTS

| | | | |
|---|---|---|---|
| 592049 | 7/1925 | France | 132/129 |
| 83167 | 10/1895 | Germany | 132/133 |
| 20460 | 10/1897 | United Kingdom | 132/144 |

OTHER PUBLICATIONS

Easy Braid Brochure, entitled "Easy Double", #300–01435 Rev. 001, 1995.

Easy Braid Brochure, entitled "Easy Upside Down", 1995.

Easy Braid Brochure, entitled "Easy Inside Out", #300–01436 Rev. 001, 1995.

Easy Braid Brochure, entitled "Easy Pixie", 1995.

Easy Braid Brochure, entitled "Easy Classic", #300–01434 Rev. 001, 1995.

Easy Braid Brochure, entitled "Easy Twist", 1995.

Easy Braid Brochure, entitled "Hints and Tips for Beautiful Braids", #300–01437 Rev. 001, four pages, 1995.

Photographs of Prior Art Clip–Type Hair Barrette (Marked as Exhibits 1–5).

*Primary Examiner*—Todd E. Manahan

*Attorney, Agent, or Firm*—Hovey, Williams, Timmons & Collins

[57] ABSTRACT

A braiding apparatus and method are provided useful in gathering and separating a person's hair into a series of discrete bundles which may be woven into braids, during which braid making process the apparatus of the invention may be left in the hair to maintain the hair bundle configuration while the braid is being made. An apparatus is provided with a pair of arcuately shaped pivotally interconnected clips having oppositely facing comb structures configured to form a series of bundle-forming slots when the comb structures are brought into registration with one another after moving the clips toward one another through the hair.

17 Claims, 2 Drawing Sheets

METHOD AND APPARATUS FOR USE IN MAKING FRENCH BRAIDS

BACKGROUND OF THE INVENTION

1. Field of the Invention

This invention relates to a braiding apparatus and method which are simple yet highly effective and which have numerous advantages including the ability to be used to gather and separate a person's hair into a series of discrete bundles useful for making braids, particularly French braids, and to thereafter maintain the bundle configuration in the hair while the braid is being made. More particularly, the invention is concerned with a pair of arcuately shaped, pivotally and releasably interconnected clips having oppositely facing comb structures configured to form the series of bundle forming slots when the comb structures are brought into registration with one another after moving the clips toward one another through the hair.

2. Description of the Prior Art

When making a French braid in a person's hair which has a pleasing appearance, problems are encountered because the braiding process involves multiple complicated steps, some of which must be performed in unison. For example, the process of making a French braid involves the gathering, separating and the holding of the hair into two distinct portions. The first portion is a part of the hair which is drawn relatively tight from the sides of the head toward a medial line extending from crest to brow. The second portion is a part of the hair which has been gathered at, and which hangs loosely, from the medial line. It is the second portion into which the French braid will be made. The process, however, requires that the second loose portion be further separated into a series of discrete bundles extending in series generally along the medial line. During the process, each bundle must yet be further separated into strands, typically left, center and right strands. The strand separation process procedes in serial order through the bundles beginning with an initial bundle and ending with a final bundle in the bundle series. The French braid is made in the strands in the conventional way by repeatedly crossing a left and then a right strand over a central strand. Immediately preceeding the crossing of the strands, however, left and right strands are combined with associated left and right strands from the next adjacent bundle, this process being repeated in serial order until the hair in each bundle has been woven into a braid.

As can be appreciated, the process of gathering, separating and holding the hair as described above requires a high level of skill and manual dexterity, and if not performed in a precise fashion, will result in a braid which is loose, non-uniform and generally unsightly. Further, the process is time consuming and if a person needs to remove their hands from the hair while making the French braid, the hair portions can quickly unravel, become slack, or otherwise lose the intended orientation.

SUMMARY OF THE INVENTION

The problems outlined above are in large measure solved by the method and apparatus for making a French braid in accordance with the present invention. That is to say, the invention provides an apparatus of light weight, compact and efficient construction, and which serves to gather, separate and hold the hair in a series of discrete bundles along the medial line while making the French braid.

The apparatus in accordance with the present invention broadly includes a pair of elongated clips which are longitudinally arcuately shaped to substantially conform to the curvature of the back of a person's head along a medial line extending from crest to neck. Comb structures are associated with the clips and are operable to gather and separate the hair into a series of discrete bundles as the clips are moved toward one another through the hair. The clips include hinge means pivotally interconnecting the clips so that movement of the clips through the hair toward one another may be carried out in a swinging motion. The swinging motion, in the preferred embodiment, will have a radius of curvature substantially normal to the medial line when the hinge means is aligned with the medial line near the neck.

The comb structures include oppositely facing fingers which cooperate to define a series of bundle-forming slots when the fingers are brought into registration with one another. The clips are configured so that when they are moved toward the medial line and held in registration with one another following the swinging motion as described above, they are operable to gather and separate the hair into two distinct portions typically necessary and desirable when making a French braid.

A first portion is a part of the hair which is drawn relatively tight from the sides of the head toward a medial line extending from crest to brow. A second portion is a part of the hair which has been gathered between and which extends above and hangs loosely from the clips. The second portion is further separated by the clips into a series of discrete bundles extending generally along the back of the person's head along the medial line.

So gathered, separated and held, the hair may thereafter be easily further separated into individual strands employed to make a French braid.

DETAILED DESCRIPTION OF THE PREFERRED EMBODIMENT

Figures 1, 2, 3, 4, 5, 12:
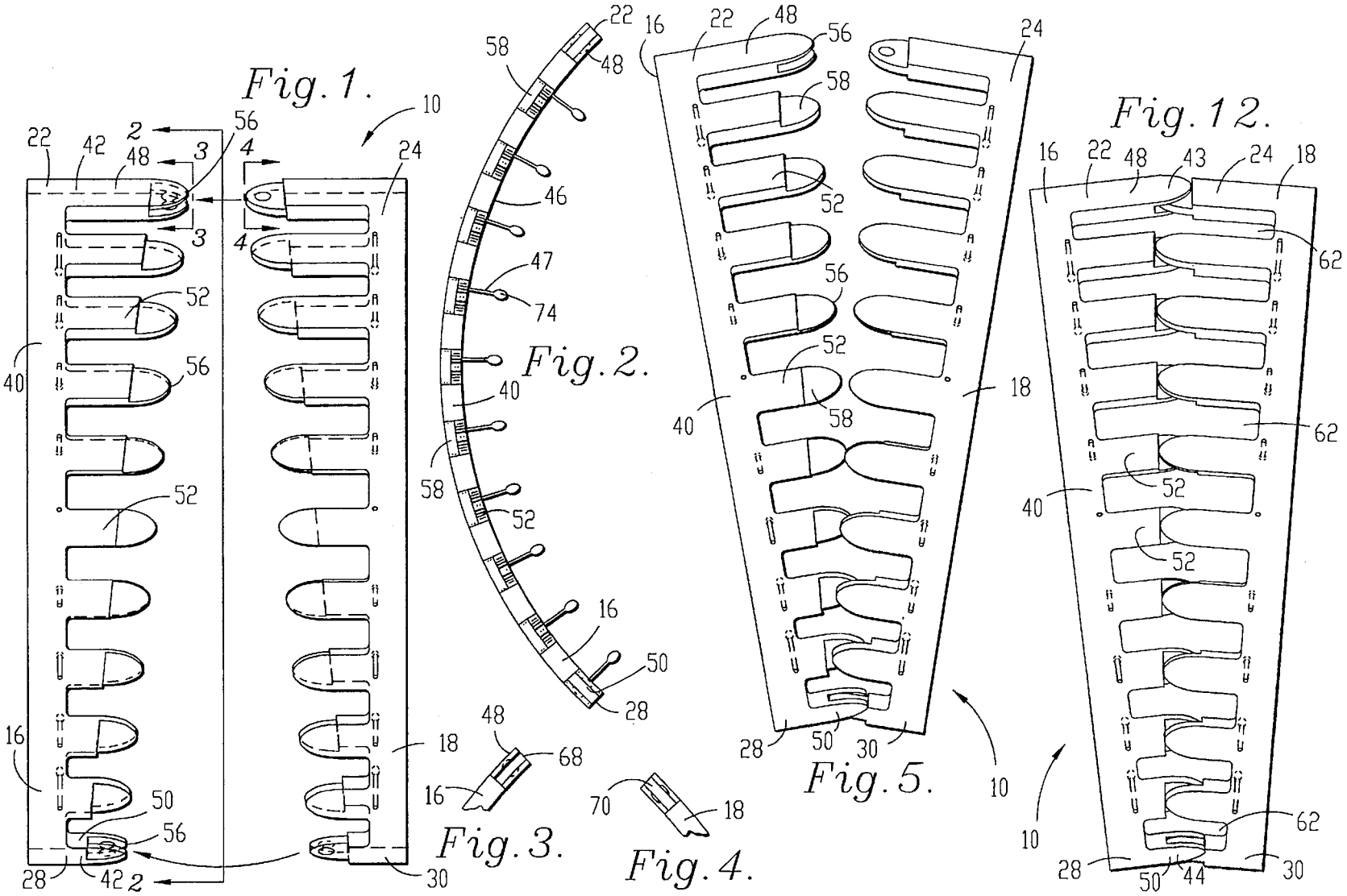
FIG. 1 is a front elevational view of an apparatus in accordance with the invention, showing left and right clips separated from one another.
FIG. 2 is a side elevational view of the left clip of the apparatus taken along the line 2—2 of FIG. 1 illustrating tip receiving notches and anchor pins.
FIG. 3 is a fragmentary side view of an upper finger of the left clip taken along line 3—3 of FIG. 1 illustrating the mutually opposed sockets of a retainer formed in the tip of the finger.
FIG. 4 is a fragmentary side view of an upper finger of the right clip taken along line 4—4 of FIG. 1 illustrating the ball portion of the retainer formed in the tip of the finger.
FIG. 5 is a front elevational view of the apparatus showing the ball-and-socket retainer hinge interconnecting the pair of clips at their lower ends.
FIG. 12 is a front elevational view of the apparatus showing the clips interconnected by retainers at their upper and lower ends.

Turning now to the drawings, a braiding apparatus 10 for use in making braids in hair 12 in accordance with the invention includes a pair of articles or left clip 16 and right clip 18. Clips 16 and 18 are longitudinally arcuately shaped to substantially conform to the curvature of the back of a person's head along a medial line extending from crest to neck, as represented by the line "a" shown in FIG. 6. Clips 16 and 18 have upper ends 22 and 24, and lower ends 28 and 30, respectively.

Clips 16 and 18 are in most respects mirror-images of one another, and thus, only left clip 16 will be described in detail, it being understood that unless otherwise indicated below, clip 18 includes corresponding mirror-image structure.

Clip 16 includes an elongated base 40 extending between and terminating at upper end 22 and lower end 28, comb structure in the form of bundle-forming fingers 42, hinge means in the form of ball-and-socket retainers 43, 44, a head engaging surface 46 and anchor means in the form of anchor pins 47.

A plurality of fingers 42 are generally parallel and extend outwardly from head engaging surface 46 adjacent to base 40 in a direction normal to the radius of the curvature associated with clip 16. In the preferred embodiment, fingers 42 are evenly spaced along base 40. Fingers 42 include an upper finger 48, a lower finger 50 and intermediate fingers 52 evenly spaced therebetween. Fingers 42 become progressively longer as upper end 22 is approached from lower end 28, as shown in FIG. 1.

Fingers 42 present relatively sharp tips 56 at their outer ends to lower resistance of fingers 42 as they are moved through the hair 12. Tips 56 include opposite tip receiving notches 58 configured to receive in overlapping relationship tips associated with corresponding and oppositely facing fingers associated with clip 18 when clips 16 and 18 are brought into tip-to-tip engagement as shown in FIG. 12.

Fingers 42 associated with left clip 16 cooperate with corresponding fingers associated with right clip 18 to form slots 62 when oppositely facing fingers are brought into registration with one another or, in the preferred embodiment, into tip-to-tip overlapping engagement, as shown in FIG. 12. The longitudinal axes of slots 62 are substantially transverse to the longitudinal axis of base 40 when right and left clips 16 and 18 are interconnected, as shown in FIG. 12. Because fingers 42 become progressively longer as the upper end 22 of clip 16 is approached from the lower end 28, slots 62 at the upper end of apparatus 10 are longer than slots at the lower end. Slots 62 become progressively longer as the upper end of apparatus 10 is approached from the lower end because of the need to accommodate progressively larger quantities of hair as the top of the head is approached from the neck along the medial line. Thus, when the oppositely facing fingers of clips 16 and 18 are brought into tip-to-tip engagement, apparatus 10 assumes a truncated triangular configuration, as shown in FIG. 12. It is to be understood, however, that slots 62 may have other dimensions and shapes which are useful to gather, separate and hold the hair for the purposes of making a braid as set forth herein.

Figure 6:
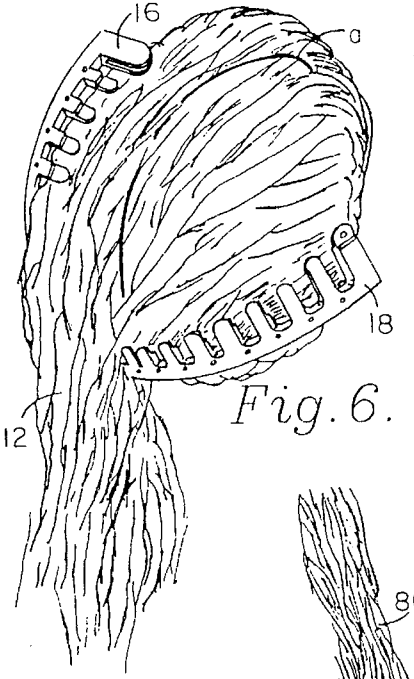
FIG. 6 is a perspective view of the back of a person's head showing the clips placed in a position at the sides of a person's head to facilitate gathering and separation of the hair so that bundles may be formed generally along a medial line extending from crest to neck.
Figure 9:
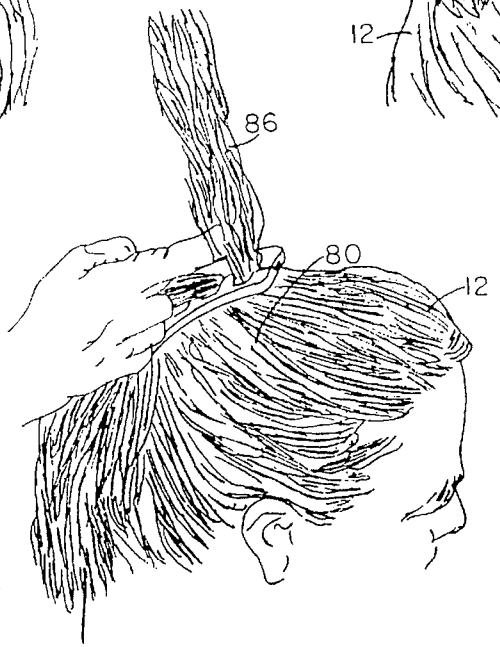
FIG. 9 is a side perspective view of a person's head showing the apparatus mounted in the hair illustrating the bundle of hair formed in the most upper slot.

Upper retainer 43 and lower retainer 44 are identical and thus only lower retainer 44 will be described in detail. Lower retainer 44 includes mutually opposed sockets 68 formed integral to the tip 56 associated with the lower finger 50 of clip 16. A ball section 70 is formed integral with the tip of the corresponding lower finger of clip 18, as shown in FIG. 1. Sockets 68 are configured to releasably receive ball section 70 and to permit swingable motion of clips 16 and 18 about retainer 44. Retainer 44 may also be configured so that the radius of curvature of the swingable motion about retainer 44 is generally normal to the arcuate curvature of clips 16 and 18. The radius of curvature of the swingable motion of apparatus 10 can thus be made to be substantially normal to the medial line "a" when lower retainer 44 is aligned with the medial line at the neck, as shown in FIG. 6. Retainers 43 and 44 are also configured to releasably interconnect upper and lower ends of clips 16 and 18, as shown in FIG. 12, to maintain the configuration of slots 62 after they are formed. Retainers 43 and 44 also serve as releasable retaining means for holding clips 16 and 18 against separation from one another after they have been moved toward one another through the hair and interconnected.

Anchor pins 47 extend radially from the head engaging surface 46 adjacent base 40. Anchor pins 47 are configured to extend through and engage with the hair 12 sandwiched between apparatus 10 and a person's head to hold apparatus 10 in place relative to the head. Anchor pins 47 are provided with heads 74 at their outer ends to minimize discomfort when pins 47 are brought into contact with the scalp.

While the dimensions of various component parts of apparatus 10 as described above may vary, the preferred dimensions will now be described. The overall length of the clip is in the range of 7–9 inches. Upper and lower fingers 48, 50 are about ½ inch wide. Intermediate fingers 52 are about ¼–⅜ inches wide. Upper finger 48 is about 1¼ inches long (base 40 to tip 56) and lower finger 50 is about ½ inch long (base 40 to tip 56). Fingers 42 are separated from one another by a distance of between ⅜–½ inches. Clips 16 and 18 are about ¼ inch in thickness. Notches 58 have a depth of about ⅛ inch and are about ½ inch in length.

Apparatus 10 may be formed of any suitable material for the purposes described herein.

The use of apparatus 10 in making French braids will now be described with reference to FIGS. 6–11. Referring to FIG. 6, clips 16 and 18 are shown interconnected at the lower retainer 44 with clips 16 and 18 rotated about retainer 44 into an open hair receiving configuration. Retainer 44 in FIG. 6 is aligned with the medial line at the neck. As clips 16 and 18 moved toward one another from the sides of the head in a swinging motion through the hair so that fingers come into tip-to-tip engagement (as shown in FIG. 12), the fingers are operable to gather and separate the hair 12 sandwiched between clips 16 and 18 into a portion 80 held in tension and a portion 82 hanging loosely and extending outwardly from apparatus 10.

Figure 8:
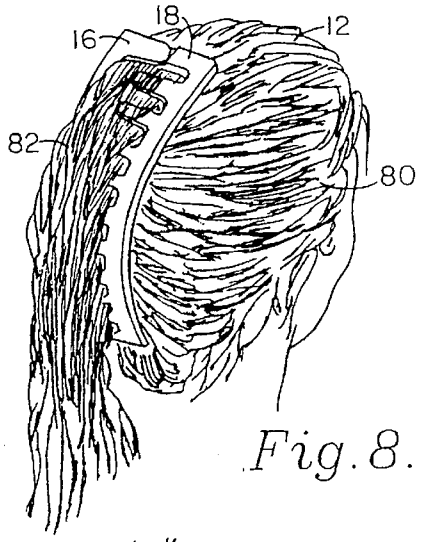
FIG. 8 is a perspective view of the back of a person's head showing the first portion of hair held in tension and a second portion formed into a series of bundles generally along the medial line.
Figure 10:
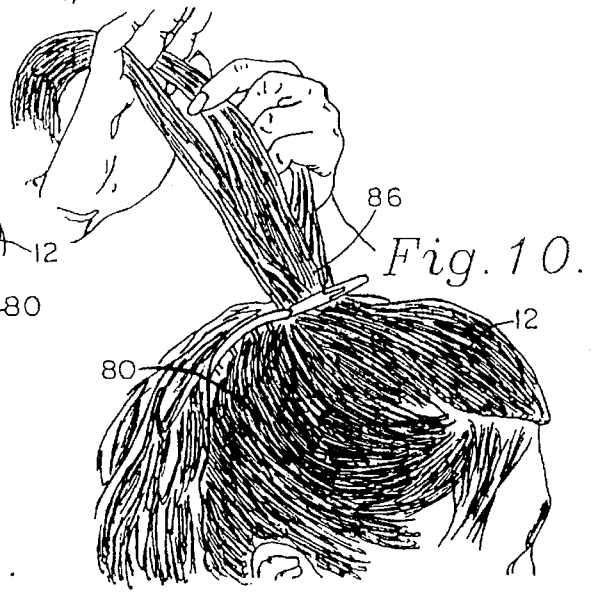
FIG. 10 is a side perspective view of a person's head with the apparatus mounted in the hair illustrating the separation of a hair bundle formed in the initial slot into three separate strands.
Figure 7:
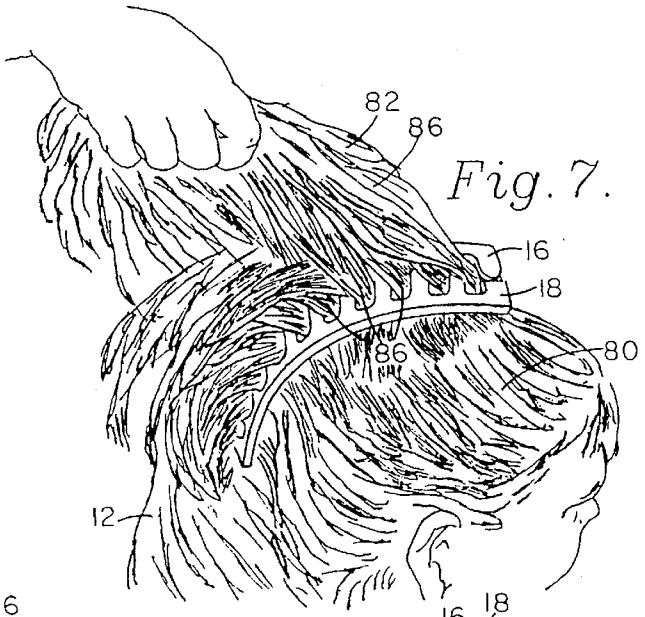
FIG. 7 is a perspective view of the side of a person's head showing the first portion of hair held in tension and a second portion formed into a series of bundles generally along the medial line.
Figure 11:
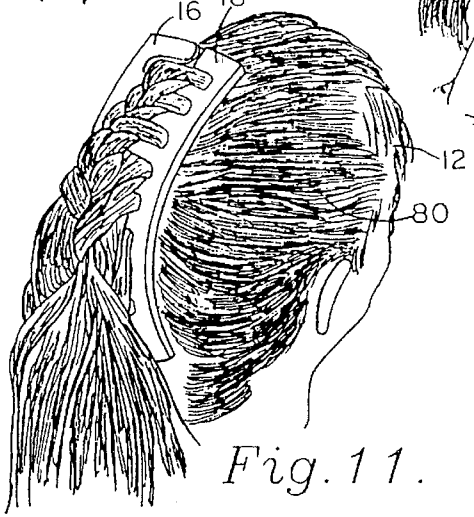
FIG. 11 is a perspective view of the back of a person's head showing the apparatus mounted and left in the hair to hold the hair in place.

Portion 80 is that portion of the hair which is drawn tight from the sides of the head toward medial line "a" and held in tension between the scalp (not shown) and the fingers of apparatus 10, as shown in FIGS. 7–10. Hanging portion 82 is a part of the hair which has been gathered between and which extends above and hangs loosely from clips 16 and 18 when interconnected by retainers 43, 44. When clips 16, 18 are brought into tip-to-tip engagement (as shown in FIG. 12), portion 82 is further separated by the fingers into a series of discrete hair bundles 86 formed in and maintained by slots 62. The overlapping relationship of tips 56 and notches 58 further enhances the ability of the fingers to separate and maintain bundles 86 in their discrete configuration. In the preferred embodiment, the series of bundles 86 are formed so that they extend generally along the medial line "a" at the back of the head, as shown in FIG. 8.

After tips 16 and 18 are moved through the hair to form hair portions 80 and 82, they are interconnected at retainers 43 and 44 to form bundles 86 in slots 62, and anchor pins 47 are used to anchor apparatus 10 in place. This is achieved when anchor pins 47 are lodged into and engaged with hair 12 sandwiched between apparatus 10 and the scalp to hold apparatus 10 and bundles 86 in place while making a braid. Because anchor pins 47 hold apparatus 10 in place, interconnected clips 16 and 18 may be left in the hair to confine bundles 86 in the discrete configuration while making the braid.

Bundles 86 may now be easily separated into left, center and right strands as necessary to make a braid. As can be appreciated, the process of making braids, especially French braids, is greatly simplified because bundles 86 formed in slots 62 may be formed adjacent and held by apparatus 10 over medial line "a" while making the braid. Further, if during the process of making a French braid, it becomes necessary to remove the hands from the hair, hair portion 80 will remain in tension, bundles 86 will retain their original configuration and a partial braid formed will be less likely to unravel.

It will be appreciated that apparatus 10 is also useful for making other types of braids having an orientation different than that described above. For example, a French braid may also be made in the hair along a line perpendicular to the medial line "a". Further, apparatus 10 may be employed to create braids other than French braids.

Although preferred forms of the invention have been described above, it is to be recognized that such disclosure is by way of illustration only, and should not be utilized in a limiting sense in interpreting the scope of the present invention. Obvious modification to the exemplary embodiments, as hereinabove set forth, could be readily made by those skilled in the art without departing from the spirit of the present invention.

The inventor hereby state their intent to rely on the Doctrine of Equivalents to determine and assess the reasonably fair scope of their invention as pertains to any apparatus not materially departing from but outside the literal scope of the invention as set out in the following claims.

I claim:

1. An apparatus for use in making braids in hair, comprising:

a pair of elongated clips, said clips being longitudinally arcuately shaped to substantially conform to the curvature of the back of a person's head along a medial line extending from crest to neck; and comb structures associated with said clips and operable to gather and separate the hair into a series of discrete bundles as said clips are moved toward one another through the hair, each of said comb structures comprising a plurality of spaced fingers, said fingers of one of the comb structures cooperating with corresponding, oppositely facing fingers of the other structure to present a series of longitudinally spaced, continuous elements extending between the clips when the comb structures are brought into registration with one another, said series of elements cooperating to define a series of open slots which are configured to confine said bundles of hair therein.

2. An apparatus as set forth in claim 1; and hinge means pivotally interconnecting the clips so that said movement of the clips toward one another is carried out in a swinging motion.

3. An apparatus as set forth in claim 2, said clips having upper and lower ends, said hinge means being located at said lower ends.

4. An apparatus as set forth in claim 2, said hinge means comprising a ball-in-socket retainer.

5. An apparatus as set forth in claim 2, said swinging motion having a radius of curvature substantially normal to said medial line when said hinge means is aligned with the medial line at the neck.

6. An apparatus as set forth in claim 1; and releasably retaining means for holding the clips against separation from one another after they have been moved toward one another in the hair.

7. An apparatus as set forth in claim 1, said clips having a head engaging surface; and anchor means associated with said head engaging surface for maintaining the position of said clips relative to the head after said bundles are formed.

8. An apparatus as set forth in claim 1, said fingers presenting innermost tips and including tip receiving notches configured to receive the tip from an associated oppositely facing finger in overlapping relationship when said bundles are formed in said slots.

9. An apparatus for use in making braids in hair, comprising:

a pair of elongated clips, said clips being longitudinally arcuately shaped to substantially conform to the curvature of the back of a person's head along a medial line extending from crest to neck; and comb structures associated with said clips and operable to gather and separate the hair into a series of discrete bundles as said clips are moved toward one another through the hair, said clips having a head engaging surface; and anchor means associated with said head engaging surface for maintaining the position of said clips relative to the head after said bundles are formed, said anchor means comprising a plurality of hair engaging pins extending radially from said head engaging surface and configured to extend through and engage with hair sandwiched between the head engaging surface and the head.

10. An apparatus for use in making braids in hair, comprising:

a pair of elongated clips, said clips being longitudinally arcuately shaped to substantially conform to the curvature of the back of a person's head along a medial line extending from crest to neck; and comb structures associated with said clips and operable to gather and separate the hair into a series of discrete bundles as said clips are moved toward one another through the hair, said pair of comb structures cooperating to define a series of slots when said comb structures are brought into registration with one another, said slots configured to confine said bundles of hair therein, said comb structures comprising a plurality of oppositely facing and spaced fingers associated with the clips, said fingers presenting tips, said fingers associated with one clip configured to cooperate with said fingers associated with said other clip to form said slots when said oppopsitely facing fingers are brought into tip-to-tip engagement, said clips each having opposite upper and lower ends, said fingers associated with each clip becoming progressively longer as the upper end of the clip is approached from the lower end so that when said fingers are brought into tip-to-tip engagement, said slots at the upper end of the clips are longer than the slots at the lower end of the clips.

11. An apparatus as set forth in claim 10; and hinge means pivotally interconnecting the clips at one end thereof so that said movement of the clips toward one another is carried out in a swinging motion.

12. An apparatus as set forth in claim 11, said swinging motion being normal to the medial line when said hinge means is aligned with the medial line at the neck.

13. An apparatus as set forth in claim 12, said hinge means being at lower end of said clips.

14. An apparatus for use in making braids in a person's hair on a scalp, comprising:

a pair of elongated clips, said clips being longitudinally arcuately shaped to substantially conform to the curvature of the back of a person's head along a medial line extending from crest to neck; and comb structures associated with said clips and operable to gather and separate the hair into a first portion in tension in which it extends between the scalp and said comb structures and a second portion which is further separated into a series of discrete bundles as said clips are moved toward one another through the hair, each of said comb structures comprising a plurality of spaced fingers, said fingers of one of the comb structures cooperating with corresponding, oppositely facing fingers of the other structure to present a series of longitudinally spaced, continuous elements extending between the clips when the comb structures are brought into registration with one another, said series of elements cooperating to define a series of open slots which are configured to confine said bundles of hair therein.

15. An apparatus for use in making braids in a person's hair on a scalp, comprising:

a pair of elongated clips, said clips being longitudinally arcuately shaped to substantially conform to the curvature of the back of a person's head along a medial line extending from crest to neck, said clips having a head engaging surface;

anchor means associated with said head engaging surface for maintaining the position of said clips relative to the head after said bundles are formed;

comb structures associated with said clips and operable to gather and separate the hair into a series of discrete bundles as said clips are moved toward one another through the hair, said pair of comb structures cooperating to define a series of slots when said comb structures are brought into registration with one another, said slots configured to confine said bundles of hair therein, said comb structures comprising a plurality of oppositely facing and spaced fingers associated with each clip, said fingers presenting tips, said fingers associated with one clip configured to cooperate with said fingers associated with said other clip to form said slots when said oppositely facing fingers are brought into tip-to-tip engagement, said fingers including tip receiving notches configured to receive the tip from an associated oppositely facing tooth in overlapping relationship when said bundles are formed in said slots, said clips each having opposite upper and lower ends, said fingers associated with each clip becoming progressively longer as the upper end of the clip is approached from the lower end so that when said fingers are brought into tip-to-tip engagement, said slots at the upper end of the clips are longer than the slots at the lower end of the clips; and hinge means pivotally interconnecting the clips at one end thereof so that said movement of the clips toward one another is carried out in a swinging motion, said hinge means being at lower end of said clips, said swinging motion being normal to the medial line when said hinge means is aligned with the medial line at the neck.

16. A method of making a braid in hair, comprising:

providing a head of hair and a pair of articles having bundle-forming fingers;

moving said pair of articles toward one another with at least a portion of said hair being sandwiched therebetween and causing said fingers to gather and separate the hair into discrete bundles;

leaving said articles in the hair to confine the bundles in the discrete configuration;

braiding the bundles into a braid while the articles remain in place; and removing the articles from the hair while the braid remains in place.

17. A method of making a braid in hair, comprising:

providing a head of hair and a pair of articles having bundle-forming fingers;

moving said pair of articles toward one another with at least a portion of said hair being sandwiched therebetween and causing said fingers to gather and separate the hair into a first portion in tension between the scalp and said bundle forming fingers and a second portion formed into a series of discrete bundles extending between said opposite ends, said movement of said pair of articles having a radius of curvature substantially normal to a medial line extending from crest to neck;

leaving said articles in the hair to confine the bundles in the discrete configuration;

braiding the bundles into a braid while the articles remain in place; and removing the articles from the hair while the braid remains in place.

* * * * *